US007347195B2

(12) United States Patent
Biljenga

(10) Patent No.: US 7,347,195 B2
(45) Date of Patent: Mar. 25, 2008

(54) METHOD AND DEVICE FOR CONTROLLING THE CURRENT IN A SPARK PLUG

(75) Inventor: Bo Biljenga, Åmål (SE)

(73) Assignee: Mecel Aktiebolag (SE)

( * ) Notice: Subject to any disclaimer, the term of this patent is extended or adjusted under 35 U.S.C. 154(b) by 162 days.

(21) Appl. No.: 11/151,464

(22) Filed: Jun. 14, 2005

(65) Prior Publication Data

US 2005/0279337 A1 Dec. 22, 2005

(30) Foreign Application Priority Data

Jun. 22, 2004 (SE) ..... 0401629

(51) Int. Cl.
*F02P 3/02* (2006.01)

(52) U.S. Cl. ..... 123/620; 123/656; 324/380; 324/399

(58) Field of Classification Search ..... 123/618, 123/620, 623, 655, 656; 324/380, 388, 391, 324/399

See application file for complete search history.

(56) References Cited

U.S. PATENT DOCUMENTS

| | | | | |
|---|---|---|---|---|
| 6,196,054 | B1 * | 3/2001 | Okamura et al. | 73/35.08 |
| 6,202,474 | B1 * | 3/2001 | Takahashi et al. | 73/35.08 |
| 6,205,844 | B1 * | 3/2001 | Morita et al. | 73/35.08 |
| 6,222,368 | B1 * | 4/2001 | Inagaki et al. | 324/399 |
| 6,275,041 | B1 * | 8/2001 | Okamura et al. | 324/380 |
| 6,336,355 | B1 * | 1/2002 | Sasaki et al. | 73/35.08 |
| 6,779,517 | B2 * | 8/2004 | Sakakura | 123/630 |
| 6,954,074 | B2 * | 10/2005 | Zhu et al. | 324/399 |

* cited by examiner

*Primary Examiner*—Hai Huynh
(74) *Attorney, Agent, or Firm*—Michael Bednarek; Paul, Hastings, Janofsky & Walker LLP

(57) ABSTRACT

The present invention relates to a method of controlling the spark current in a spark plug (8), comprising a voltage source (1; 14), an ignition system (2) connected to the voltage source, and a spark plug (8) connected to the ignition system, which ignition system (2) comprises an ignition coil (3) and at least one regulating unit (5, 6) as well as a control unit (4), enabling control of the intensity and/or duration of the spark current, said ignition coil (3) comprising a secondary side (6, 31) arranged to be controlled in order to control the duration of the spark in Arc Discharge Mode. The invention also relates to an ignition device.

21 Claims, 2 Drawing Sheets

Fig. 1
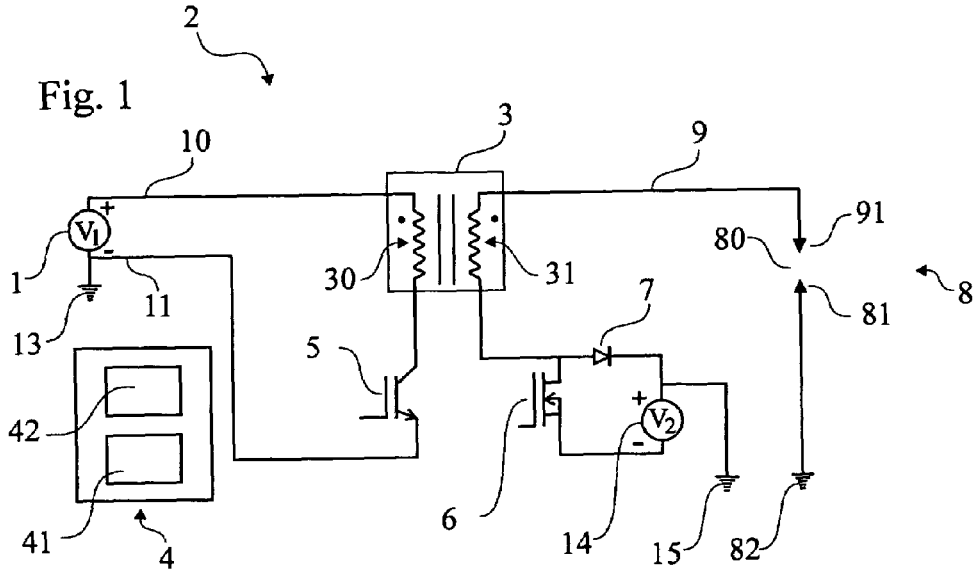
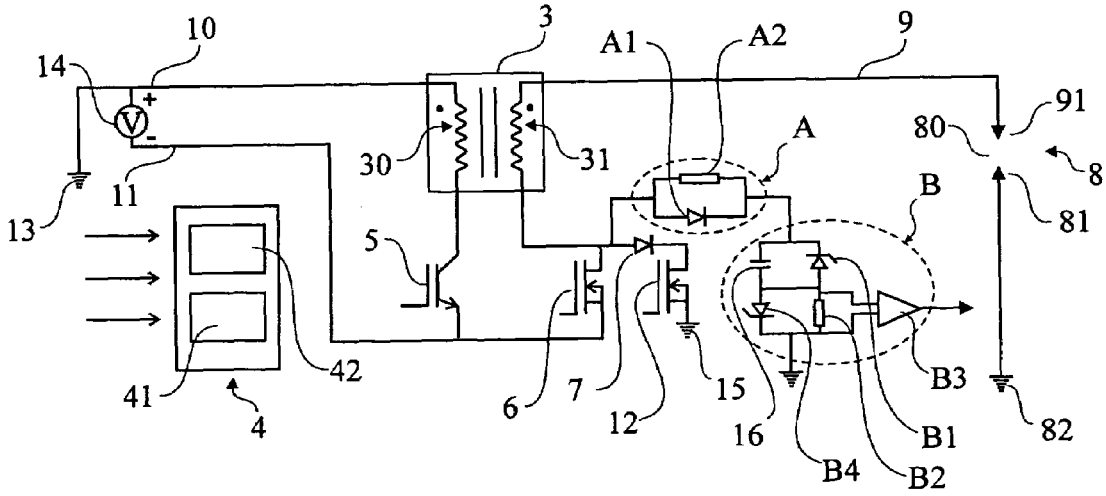
Fig. 2

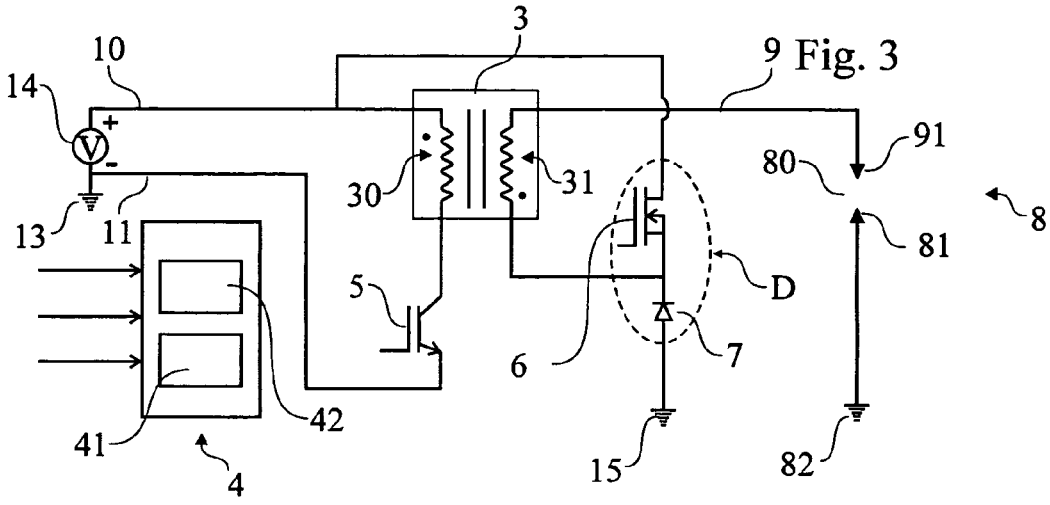
Fig. 3
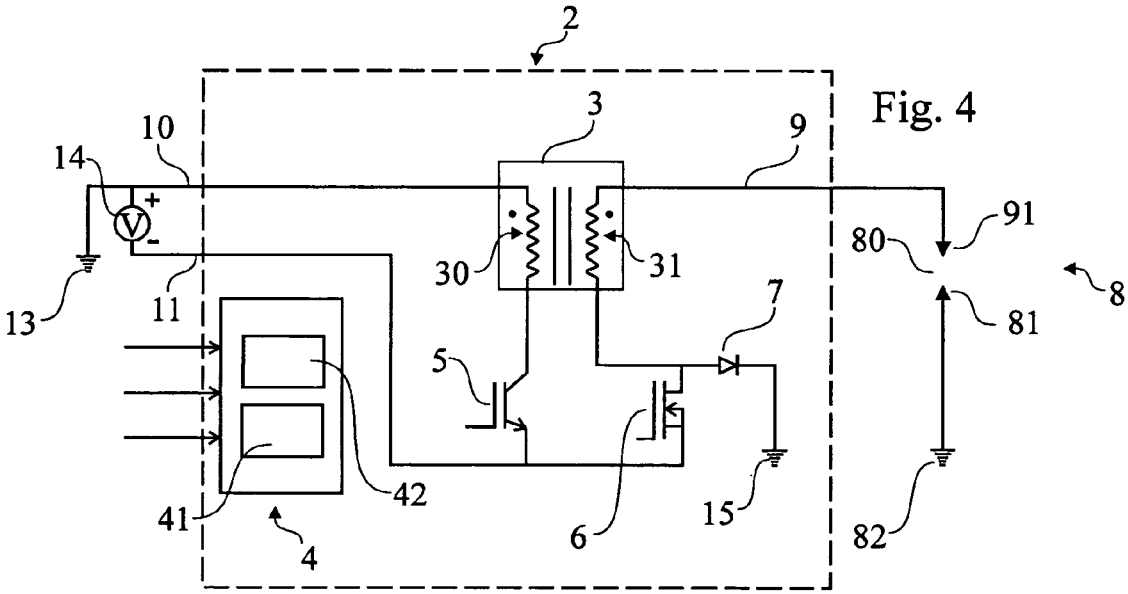
Fig. 4
Fig. 5
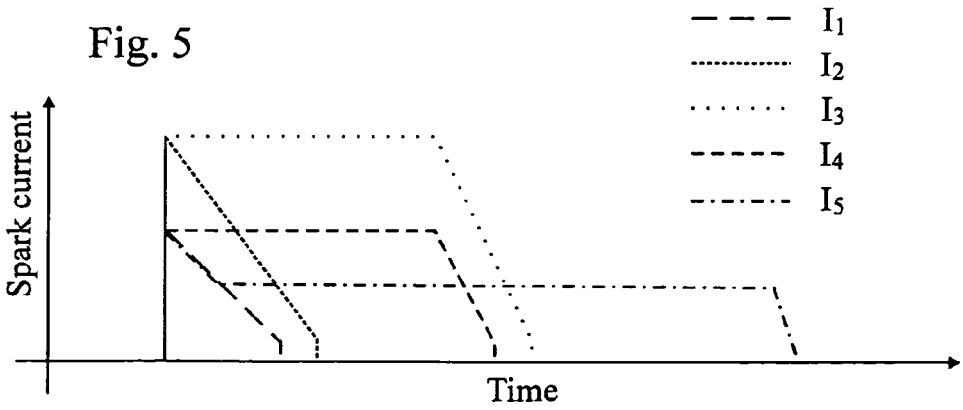

METHOD AND DEVICE FOR CONTROLLING THE CURRENT IN A SPARK PLUG

TECHNICAL FIELD

The present invention relates to a method of controlling the spark current in a spark plug, which spark plug is part of a ignition system, the method providing the possibility to control the intensity as well as the duration of the spark current, and thereby also the energy released by the spark. The invention also relates to a device for accomplishment of such control.

PRIOR ART

Many of the internal combustion engines of today make use of spark plugs to ignite a mixture of fuel and air. This takes place for example in the Otto engine, in which a premixed mixture of fuel and air is ignited. Spark plugs are also used in direct injection engines, in which fuel and air is mixed directly in the cylinder. Common fuels of today are different types of hydrocarbon compounds, such as petrol, alcohols and various gases such as natural gas and biogas. In the future, hydrogen gas may also be used.

The function of the spark plug is mainly at a given point of time to ignite a small portion of the mixture of fuel and air close to the spark plug, where after the combustion continues in the cylinder by aid of flame spreading.

When a spark arcs between the electrodes of the spark plug, a plasma channel of very high temperature is formed between the electrodes, which plasma channel can have a diameter in the magnitude of 0.1 mm and a typical length of 1 mm. At the surface of the plasma channel, the temperature is beneficial for ignition of the mixture of fuel and air, provided that there is an ignitable mixture close to the spark plug. Normally, the least energy is required to ignite a mixture of fuel and air that is nearly stoichiometric (close to lambda 1). As the fuel-to-air ratio close to the spark plug often varies over time, ignition systems of today normally deliver a spark of relatively long duration, about 1-2 ms. This is to ensure that ignition takes place. The drawback of this procedure is that the point of time for ignition of the fuel and air mixture can vary from cycle to cycle, which results in cycle to cycle variations of the torque delivered by the cylinder, from one combustion cycle to another.

A spark discharge can be characterised by a number of phases. First, the ignition system delivers a high-voltage pulse to the spark plug. When the voltage has risen typically to 10-20 kV, a spark-over takes place between the electrodes. The first phase is called "Breakdown Phase" and has a duration of a few nanoseconds. The voltage over the plug is high, and the current in the plug can be tens of Amperes. The next phase is the "Arc Phase", typically having a duration of some microseconds. In this phase, the voltage between the electrodes is typically 50-100 V, and the current is in the magnitude of 1-10 A. The last phase is the "Glow Phase", typically having a duration of a few milliseconds for a standard inductive ignition system. In this phase, the voltage between the electrodes is typically 500-1000 V, and then the ignition coil of the ignition system delivers a current in the magnitude of 10-100 mA dropping relatively linearly to zero. For most ignition systems of today, the major part of the energy release over the spark plug normally takes place during the "Glow Phase".

To facilitate ignition, especially of lean but also of rich mixtures, as well as inhomogeneous mixtures, the fuel-to-air ratio of which varying over time in the vicinity of the spark plug, it would be beneficial to design an ignition system that delivers a stronger spark, the plasma channel of which being of more intense current and having a larger effective surface during a shorter and more well defined time period. It would in other words be an advantage if an ignition system could be designed that principally operates in "Arc Phase", and for which the "Arc Phase" is extended in time to be at least some hundreds of microseconds or up to about one millisecond, depending on the desired duration of the spark.

In order for an engine to be able to run on different fuels, it is also an advantage to be able to vary the spark in dependence of how easy the fuel is to ignite. This can also be of interest in other circumstances, such as at cold starting or in damp weather, when ignition of the fuel mixture can be more difficult than what is normal. Today, there are also engines with variable EGR (Exhaust Gas Circulation). At a high EGR, the concentration of inert gases is higher in the cylinder, whereby ignition of the fuel mixture can be more difficult, and in which case it may be of interest to have a more intense spark with a larger energy content.

A more intense spark may however give rise to an increased wear of the spark plug, as well as an increased consumption of electrical energy, which means that it is not desired without cause to have a too intense spark or a spark of too long duration. It would in other words be beneficial if the duration of the spark and the intensity of its current could be varied in dependence of a variety of circumstances. Furthermore, in case the engine runs on very high speed, it may be unnecessary for the spark to have a very long duration, as the purpose of the spark is only to start the combustion in the cylinder.

Spark plugs can also be used as sensors to get information about the combustion process. In order to achieve this, a relatively low voltage of e.g. 50-200 V can be applied over the spark plug after a completed spark, while measuring the current that passes between the electrodes of the spark plug. This current as a function of time will give information about the conductivity of the gas close to the spark plug during the combustion process, which among other things can give information about the time progress of the spark plug after the completed spark. Ignition systems utilising the spark plug as a sensor are said to be equipped with an ion-flux system, where the ion-flux is the current flowing between the electrodes of the plug at a given applied voltage over the plug after a completed spark. Normally, this current is low in relation to the spark current. Most often, the ion-flux has a magnitude of 1-1000 μA during a combustion process. In order to be able to make full use of an ion-flux system, it is important that the duration of the spark is short in relation to the time of combustion in the cylinder. This is because the combustion information can be achieved only after the disappearance of the spark current. When the spark current has reached a value close to zero, another phenomenon usually arises which is called coil ringing. When the spark over the plug disappears, there is a strong increase in the impedance between the electrodes of the spark plug, resulting in self-oscillation in the secondary circuit of the ignition coil, of which circuit the spark plug forms part. After the attenuation of this self-oscillation, measuring of the ion-flux can be commenced.

For ignition systems using the spark plug as an ion-flux sensor, it is accordingly important that the duration of the spark is short in comparison with the combustion time in the cylinder, and that the time of coil ringing is short.

From U.S. Pat. Nos. 5,197,448, 4,033,316, 4,136,301, 4,301,782 and 4,345,575, is known various methods of supplying energy to the secondary side of an ignition coil, in order to increase the spark current or to extend the spark current after ignition of the spark plug, which methods however have some drawbacks.

U.S. Pat. No. 5,197,448 makes use of a CDI (Capacitive Discharge Ignition) system on the primary side, and a charged capacitor placed on the secondary side of the ignition coil in order to supply energy to the spark plug either via a high-voltage diode or via an ignition coil having a saturatable core in order to increase the current in the spark plug by aid of the energy stored in the capacitor on the secondary side. A typical current of the voltage source is said to be 600 V on the primary side and −600 V on the secondary side. Accordingly, it is evident that costly and complex equipment is required, for example in the form of a 40 kV high-voltage diode (alternatively an ignition coil having a saturatable core). Also, this device will not really make it easy to control neither the spark current nor its duration. Instead, the charged capacitor will discharge quickly, via the diode and the spark plug, and give rise to an intense but short current impulse through the spark plug after it has ignited, with a duration of perhaps some tens of microseconds.

U.S. Pat. No. 4,033,316 utilises a conventional inductive ignition system combined with a voltage source on the secondary side, typically having an amplitude of 1 kV-4 kV, in order to enhance and extend the spark. Neither that invention shows any good method for controlling the spark current nor its duration, but simply a way of extending it. U.S. Pat. No. 4,136,301 discloses a development of U.S. Pat. No. 4,033,316, in which it has been added the use of a DC/DC converter containing among other things a transformer and a rectifier in order to obtain a variable output voltage, such as between voltages 1 kV and 4 kV, in order to adapt the voltage source to the engine conditions in question. Here, a certain possibility is achieved to adapt the spark in relation to the engine conditions, but the invention does not disclose any method of controlling the current in the spark during its duration, in order for example to achieve a specific shape of the current curve or in order to achieve a spark with a predetermined duration.

U.S. Pat. No. 4,301,782 uses a DC/DC converter having a current outlet connected to the high-voltage side of the spark plug, via an inductor, in order to increase the current in the spark plug after ignition. U.S. Pat. No. 4,345,575 uses a high-voltage capacitor charged to a high voltage that is discharged through a resistor connected to the high-voltage side of the spark plug, in order to increase the current in the spark plug after ignition. In common for these to last mentioned methods is the drawback that the energy is supplied to the high-voltage side of the ignition coil, which is more complicated than if the energy is supplied to the low-voltage side of the ignition coil.

All methods mentioned above disclose the use of a high-voltage source in order to affect the spark current, which is a drawback from the point of view that a high voltage is relatively hard to achieve compared to a lower voltage. Furthermore, non of the inventions discloses a method of achieving a spark for which it is easy to control the current intensity and duration in Arc Discharge Mode.

Accordingly, no real good method exists today for controlling the spark current in an ignition device, such as a spark plug in a combustion chamber.

ACCOUNT OF THE INVENTION

It is an object of the present invention to eliminate or at least minimize any one or some of the problems mentioned above, which is achieved by a method according to claim 1.

Thanks to the invention, there is surprisingly obtained a both simple and cost-efficient method to achieve an ignition system with a controllable spark current and duration of the spark. The cost-efficiency is achieved inter alia by the ability to eliminate high-voltage electronic components, such as a high-voltage diode. Simplicity is achieved inter alia by a lower control voltage being easier to accomplish than a higher voltage.

The invention enables an advantageous ignition system that is able to achieve an intense spark during a predetermined burning time. The spark gap or spark plug operates during the major part of the burning time in Arc Discharge Mode, which results in an intense spark with a large "surface" for igniting a mixture of fuel and air, which is especially advantageous in the cases in which the fuel mixture is harder to ignite, such as at ignition of very lean mixtures.

Furthermore, a preferred embodiment of the invention advantageously enables the spark current as well as its duration to be varied independently of each other but depending on the current operating conditions of the engine or depending on outer circumstances such as fuel quality or weather.

Moreover, thanks to a preferred embodiment of the invention, it is possible to let the control circuit be connected in a phase in which no current is flowing on the primary side of the ignition coil, which means that the requirement is eliminated of trying to minimize the coupling between the voltage source on the secondary side and the primary side, respectively.

The invention is especially advantageous in case the spark plug is used as an ion current sensor, since in that case it is especially important to be able to limit the duration of the spark and be able to limit the time of coil ringing to the initial phase of the combustion, whereby the spark plug can be used as sensor during the major part of the combustion process.

Additional aspects and advantages of the invention will be clarified in connection with the following detailed description.

BRIEF DESCRIPTION OF THE DRAWINGS

In the following, the invention will be described in greater detail with reference to the appended drawings, of which:

FIG. 1 shows a schematic circuit diagram of a preferred embodiment of the invention, FIG. 2 shows a somewhat modified circuit according to FIG. 1, and having a supplementary ion current device, FIG. 3 shows another alternative embodiment of the invention, in the form of voltage generation with another polarity, FIG. 4 shows yet another alternative embodiment of the invention, and FIG. 5 is a diagram showing how the spark current according to the invention can be generated over time.

DETAILED DESCRIPTION

FIG. 1 shows a preferred embodiment of an ignition system according to the invention. It is shown that the ignition system, that is fed by voltage from a voltage source 1, such as a 12, 24 or 42 Volt battery, that is grounded 13. The positive pole 10 of the voltage source is connected to a first end of the primary coil 30 of an ignition coil 3. The negative pole 11 is connected to a first control unit 5, that is formed from a first transistor 5 connected to said negative pole 11 via the emitter. The collector of the first transistor 5 is connected to the other end of the primary coil 30 of the ignition coil 3, whereby a first circuit can be closed over the primary coil 30. This first circuit, called a primary circuit, is not different in circuit design from a conventional inductive ignition system.

In the following, the secondary circuit of the ignition system will be described, which secondary circuit differs in circuit design from a conventional inductive ignition system. A first end of the secondary coil 31 is conventionally connected, via a connection 9, with the gap 80 and ground point 82 of the spark plug, such that the secondary coil 31 can affect the voltage over the gap 80 formed by the spark former 91, 81 of the spark plug. A control circuit 6, 7, 14 is arranged between a second end of the secondary coil 31 (included in the ignition coil 3) and ground point 15. This circuit comprises a first part circuit having a second transistor 6 and a second voltage source 14. A suitable DC converter, of a type known per se (not shown), suitably converts the voltage from the voltage source 1 to obtain a second voltage source 14 with a suitable negative voltage, normally about −100 V, which however can be varied within the range of e.g. (−60)-(−140) V. By its collector, also called drain, the transistor 6 is connected with said second end of the secondary coil 31, and by its emitter, also called source, it is connected with the negative pole of the second voltage source. In a parallel circuit with the transistor 6 and the voltage source 14, a diode 7 is arranged, which enables current to flow only in the direction from the primary coil, over the second part circuit, i.e. passing the part circuit including the second transistor.

A control unit 4 is arranged to control both transistors 5, 6. The control unit receives input signals from a parent engine control member that determines the timing of the spark, its duration and current strength, or that alternatively chooses between some different pre-programmed shapes of the spark curve. The control unit 4 comprises a logic unit 41 for time control, in order to control the different units with optimal timing. The control unit 4 can also contain a regulating member 42 for current regulation of the current through the primary coil 30 and the secondary coil 31, respectively, which currents can be measured e.g. over a suitable measuring resistance arranged in series with the primary coil and the secondary coil, respectively (not shown in the drawings). In addition, the control unit 4 comprises drive units for control members in the control loop. By this control unit 4, the transistor 5 is controlled in a way that is conventional for an inductive ignition system, i.e. the transistor is brought to conduct for a predetermined time, often called "dwell time", whereby current flows through the primary coil 30 of the ignition coil 3, such that energy is accumulated in the ignition coil. When the transistor 5 is shut off, a high voltage pulse is formed over the secondary coil 31 of the ignition coil, which forms a spark over the gap 80 of the spark plug, whereby the energy accumulated in the ignition coil is discharged in the secondary circuit of the ignition system. According to the invention, a control circuit 6, 7, 14 has been added to the secondary side 31 of the ignition coil, for controllability of the duration and current intensity of the spark. After a spark having been established over the spark plug, this control circuit supplies energy to the secondary circuit. By connecting and disconnecting a voltage source 14 in series with the ignition coil 3, during the burning time of the spark and by aid of the transistor 6, the current intensity of the spark as well as its duration can be controlled. The voltage source 14 should be of the same magnitude as the sum of the voltage drop over the spark plug and the resistive voltage drop in the ignition coil. If the voltage drop over the spark plug is assumed to be about 60-80 V and the resistive voltage drop over the ignition coil some tens of Volts, the control voltage can suitably be about 100 V, although it may be varied for example in the range of 50-150 V. If the control voltage is lower than the just mentioned voltage drop, the supplied energy can only be used to extend the duration of the spark current, not to increase the spark current above the maximum value generated by the ignition coil. If the control voltage is higher than the just mentioned voltage drop, the spark current can be increased too. By connecting and disconnecting this voltage source 14, during the burning time of the spark and by aid of a suitable control method, the shape of the spark current curve can be controlled as a function of time in order to achieve a desired shape of the curve (see FIG. 5). The spark current can be controlled against a desired value or a desired shape of the curve or desired current duration, by measuring the current flowing through the secondary coil 31. Accordingly, after the ignition of the spark plug, the control circuit 4 controls the current in the primary circuit as well as the current in the secondary circuit, such as the duration of the spark by time control of the transistors 5 and 6.

To achieve a short and intense spark with a low voltage drop, the ignition coil 3 has a very low inductance on its secondary side 31 (typically 1-100 mH), as compared to a standard ignition coil (typically 1-100 H). A low inductance also means few turns in the coil, whereby a more coarse wire can be used which also gives a low inner resistance in the coil (typically 1-10 Ohm), instead of a standard resistance in the magnitude of kOhm. If about the same amount of energy is accumulated in this ignition coil 3 according to the invention, as in a standard ignition coil, the maximum current delivered by the coil 3 will be 1-2 magnitudes larger than the current from a standard ignition coil, which means a maximum current in the magnitude of 1 A or more, as compared to the 10-200 mA delivered by a standard ignition coil. This means that for the major part of the time, the spark plug 8 will be in Arc Discharge Mode, with a typical voltage drop of 50-100 V over the spark plug, which differs from a standard ignition system in which the spark plug operates in Glow Discharge Mode for the major part of the time, with a typical voltage drop over the spark plug in the magnitude of 500-1000 V. The time that the ignition coil 3 according to the invention can deliver a spark in Arc Discharge Mode depends on the design of the ignition coil and the amount of energy accumulated in the ignition coil 3, but typically the time is some hundreds of microseconds.

The turns ratio between primary coil and secondary coil in the ignition coil 3 is suitably about 1:20, but can be varied for example between 1:8 and 1:30, depending on the current/voltage ratio desired over the first transistor 5 and the maximum voltage required over a spark plug 8 to which the ignition system is connected.

In order to be able to accumulate a suitable amount of energy, e.g. 20-100 mJ, in an ignition coil 3 with an inductance that is so much lower than usual, a switch transistor 5, e.g. a IGBT, is suitably used in the primary circuit. The switch transistor 5 has a relatively high current and voltage threshold failure levels compared to a conventional inductive ignition system. A typical voltage threshold failure level of this transistor 5 can be 1700-2500 V, but voltages in the range of 1000 V-5000 V can also be used. Depending on the spark current requirements, the transistor should be able to handle a primary current in the magnitude of 10-200 A. The higher the current, the lower is the voltage threshold failure level.

Suitably, the second transistor 6 has a voltage threshold failure level of 150-400 V. The current rating for this transistor 6 depends on the current intensity in the desired spark, but is normally in a range of 1-5 A.

FIG. 2 shows an alternative embodiment provided with a supplementary ion current device. Many of the components in FIG. 2 are the same (with the same reference numbers) as in FIG. 1, and therefore they will not be described in detail, but only additional supplementary components are described. It is shown among other things that the same voltage source 14 is used to feed both the primary circuit 5, 30 of the ignition system and its control circuit 6, 31 that according to the invention supplies energy in the secondary circuit 6, 31, 9 of the ignition system. Accordingly, also the second transistor 6 is here connected to the negative pole 11, via its emitter, also called source. In this case, one and the same voltage can be used, of e.g. 50-150 V, which enables a simple and cost-efficient implementation. In this case, the primary and secondary coils are easily combined in the same physical unit (see FIG. 4), and the ignition unit with the ignition coil can for example be placed close to each spark plug 8. Then, the voltage transformation between the battery voltage of the engine and the voltage required to operate the ignition device, can take place centrally, by aid of a direct current transformer (not shown), which is a technique known per se.

A control unit 4 is also shown, which among other things comprises a logic unit 41 for time control, in order to achieve optimal control timing for the different units, and preferably also a regulating member 42 for current regulation in the primary and secondary circuits. Moreover, it comprises drive units for regulating elements in the regulating circuit. Accordingly, the control circuit controls the ignition current, the duration of the spark and the triggering time for various control variables.

During the time that a spark exists in the gap 80, either one of the second 6 and third 12 transistors will be active, depending on if it is desired to supply more energy to the spark or not. At the end of the spark formation, these two transistors 6, 12 will be shut off and then a spark current will charge the capacitor 16. After the completion of the spark, this capacitor 16 will give a positive voltage over the spark plug 8, and thereby the generated low current in the spark plug can be used for ion current measuring.

FIG. 2 also shows that two additional circuits A, B are arranged at the secondary side 31, which means that the ignition system is also provided with an ion current functionality, giving a number of additional advantages. Normally, the spark is very brief and the coil ringing is of very short duration, thanks to the very low inductance in the secondary circuit 31 of the ignition coil. Furthermore, the duration of the spark can be controlled such that in case of fast combustion, such as at when the engine runs at high speed or at lambda=1, the duration of the spark is short, while in other operating conditions, a slower combustion can allow for a longer duration of the spark without losing valuable information from the ion current signal, as it is desired to have access to this signal for the major part of the combustion process.

Accordingly, it is shown that the circuit A comprises a diode A1 enabling fast charging of the capacitor 16 at the end of the spark current, as well as a resistor A2 that together with the diode A1 prevents fast discharge of the capacitor 16 during the duration of the spark. The just mentioned resistor A2 is also used in order for the ion current to be able to pass without a large voltage drop.

The circuit B is used to measure the ion current and to augment it to a useable measuring signal that can be used for control and monitoring of the combustion engine. The capacitor 16 is the voltage source driving the ion current, and the Zener-diode B1 in parallel with the capacitor 16 is used in connection with the charging of the capacitor 16 in order to determine the voltage value of the capacitor. The circuit also includes a measuring resistance B2 that the ion current passes, augmented by an associated augmenter B3. The inlet terminal of the augmenter is protected by an additional protection diode B4 that limits the voltage over the measuring resistance B2 at charge of the capacitor 16 and at discharge of the capacitor 16 during the duration of the spark.

FIG. 3 shows yet an alternative embodiment also containing many components that are the same as in FIG. 1 (with the same reference numbers), and that accordingly will not be described in detail. The modification consists in the circuit being designed to be used for a spark plug for which the ground electrode is desired to function as a cathode, i.e. emitting electrodes. This means that the electrode 91, that usually is the mid-electrode of the spark plug, will have a positive voltage during the spark.

FIG. 4 shows another embodiment of an ignition system according to the invention, in principle using the same type of connections as in FIG. 2 for the control circuit 6, 7, but without the ion current device. It is shown that the ignition coil 3, control unit 4, and control circuit 5, 6, 7 can be arranged in one and the same physical unit, which in some cases is beneficial.

FIG. 5 shows a diagram illustrating that by measuring the spark current or by having knowledge of existing voltage drops in the circuit, a control unit 4 can, with some limitations, be made to affect a circuit according to the invention to deliver any chosen or predetermined shape of the spark current curve. The control unit 4 can e.g. be pre-programmed to deliver a number of different predetermined shapes of the spark current curve, of different durations, in order to thereby be able to deliver the shape of the spark curve that corresponds the best with the requirements of the engine at this given point of time, e.g. depending on the speed of the engine, the torque, the fuel-to-air ratio, the EGR-content, the type of fuel, the temperature of the engine, the air humidity, or other parameters that can affect the initial phase of the combustion in the cylinder and thereby also the requirements for the spark current and its duration.

Specifically, FIG. 5 shows different curves for control of an ignition system according to the invention, where the Y-axis denotes the size of the current and the X-axis denotes time. I1 is a case in which the first transistor 5 is shut off at low current in the primary coil and in which the second transistor 6 is not active at all. I2 is a curve for which the first transistor is shut off at a high current, while the second transistor 6 is not active at all. I3 is a case in which the first transistor 5 is shut off at a high current and the second transistor 6 is activated without delay and maintained active for a period of medium length. I4 is a situation in which the first transistor 5 is shut off at a low current and the second transistor 6 is activated without delay and maintained active for a period of medium length. I5 is a case in which the first transistor 5 is shut off at a low current (following the same curve as I1) and the second transistor 6 is activated with a small delay and maintained active for a long period of time. The diagram shows a situation in which the voltage source 14 according to FIGS. 1 to 4 has a voltage that is about equal to the sum of the voltage drop over the gap 80 of the spark plug and the resistive voltage drop in the secondary coil 31 of the ignition coil. Since the voltage drop of the spark often varies, it is however advantageous to arrange for control of the current during the time course of the spark, which is achieved by connecting and disconnecting the voltage source 14 by aid of the transistor 6 during the duration of the spark, in order thereby to control the current through the secondary circuit against a desired value.

Accordingly, it is clear that by aid of the invention different types of spark currents can be achieved in varied ways, allowing for adaptations to any type of situation that is desired.

All ignition devices according to the invention can be controlled by aid of a control signal in order to control the point of time of the spark, another control signal determining the duration of the spark and a third control signal that determines its current intensity. As an alternative, a control signal can be used that orders any one of a number of pre-programmed shapes of the spark curve. It is also conceivable that these control signals are combined to a single control signal that by aid e.g. of a suitable pulse code determines both time point and current intensity, as well as duration of the spark.

The invention is not limited to that described above, but can be varied within the scope of the claims. Accordingly, it is realised, among other things, that the control principles of the invention can be used also to control the spark current in a conventional ignition system, mainly operating in Glow Discharge Mode with a higher voltage drop over the spark plug. Part of the benefits is however lost in that case, since the duration of the spark is often adequately long and there normally is no greater need of further extending its duration. Moreover, an energy source of relatively high voltage output, in the magnitude of 500-1000 V, is needed in this case in order to beneficially affect the shape of the spark current curve, which means that implementation becomes more costly.

It is also realised that the invention not necessarily has to be used in connection with each spark plug, but that the invention also may be arranged in a central unit that is connected by ignition cables to the various spark plugs of the engine.

TERMINOLOGY

It is realised that the concept of ignition system is not to be interpreted with limitations. This is especially the case since the person skilled in the art knows that different parts of the ignition system can be supplied as modules. By the concept of ignition system according to the claims it is accordingly understood that at least one or some essential components are included to work the invention.

IGBT stands for Insulated Gate Bipolar Transistor.

MOSFET is the English denotation of a field effect transistor having a metal oxide drive.

The invention claimed is:

1. A method of controlling the spark current in a spark plug (8), comprising a voltage source (1; 14), an ignition system (2) connected to the voltage source, and a spark plug (8) connected to the ignition system, which ignition system (2) comprises an ignition coil (3) and at least one regulating unit (5, 6) as well as a control unit (4), enabling control of the intensity and/or duration of the spark current, characterized in that said ignition coil (3) comprises a secondary side (6, 31) arranged to be controlled in order to selectively control the duration of the spark in Arc Discharge Mode by activation or de-activation of at least one of the at least one regulating units.

2. A method according to claim 1, characterized in that said secondary side (6, 31) is controlled at voltage; below 500 V.

3. A method according to claim 1, characterized in that said control takes place by aid of at least one transistor (5, 6) and one diode (7).

4. A method according to claim 3, characterized in that said at least one transistor (5, 6) controls an additional voltage supplied to the secondary coil (31).

5. A method according to claim 4, characterized in that said additional voltage is supplied from the same voltage source (14) that drives the primary side (30).

6. A method according to claim 4, characterized in that said additional voltage is supplied from a second voltage source (14).

7. A method according to claim 1, characterized in that a transistor (5) is connected to the primary side (30) of said ignition coil (3).

8. A method according to claim 1, characterized in that the current in the secondary circuit (31) is controlled to achieve a voltage drop over the spark plug (8) of between 20 and 200 V in Arc Discharge Mode.

9. A method according to claim 8, characterized in that said current is between 0.5 and 10 A.

10. A method according to claim 1, characterized in that a circuit (A, B) is connected for measuring ion current via the spark plug (8).

11. A method according to claim 10, characterized in that said circuit (A, B) comprises a first part circuit (A) arranged to quickly charge a capacitor (16) in a second part circuit (B) comprising components (B1, B2, B3, B4) arranged to produce a measurable signal from the ion current.

12. A method according to claim 1, characterized in that said control unit (4) controls at least one, of the following variables: spark current, duration of the spark, time point of ignition.

13. A method according to claim 1, characterized in that said controlling is achieved by measuring the spark current with the purpose of delivering a predetermined shape of the spark current curve over time, wherein a number of shapes of the spark current curve are preprogrammed in the control unit (4), being of different durations and being adapted to different requirements of the engine at different conditions.

14. An ignition system for the controlling of the spark current in a spark plug (8), comprising an ignition coil (3) and regulating members (5, 6, 7; 5, 6, 7, 14; 5, 6, 7, 12) arranged to control the operation of said ignition coil (3), which comprises a primary coil (30) and a secondary coil (31), characterized in that said regulating members (5, 6, 7; 5, 6, 7, 14; 5, 6, 7, 12) comprise at least one first transistor (5) connected to the primary coil (30), and a second transistor (6), as well as a diode (7) connected to the secondary coil (31), wherein the spark current in the spark plugs is selectively controlled by activation or de-activation of the second transistor.

15. An ignition system according to claim 14, characterized in that said secondary coil (31) has an inductance below 1000 mH.

16. An ignition system according to claim 15, characterized in that said secondary coil (31) has an inner resistance below 600 Ohm.

17. An ignition system according to claim 14, characterized in that the first transistor (6) is a switch transistor.

18. An ignition system according to claim 14, characterized in that at least one of said transistors (5, 6) is of MOSFET type.

19. An ignition system according to claim 14, characterized in that the ignition coil is of inductive type.

20. An ignition system according to claim 14, characterized in that said control unit (4) comprises a logic unit (41) for time control of said regulating members (5, 6).

21. An ignition system according to claim 14, characterized in that the turns ratio between the primary and secondary coils (30, 31) in said ignition coil (3) is between 1:5 and 1:50.

* * * * *